US008579609B2

(12) United States Patent
Lee et al.

(10) Patent No.: US 8,579,609 B2
(45) Date of Patent: Nov. 12, 2013

(54) FAN AND INNER ROTOR MOTOR THEREOF

(75) Inventors: Chin-Hong Lee, Taoyuan Hsien (TW); Po-Hao Yu, Taoyuan Hsien (TW); Yi-Ching Chiu, Taoyuan Hsien (TW); Shir-Harn Yeh, Taoyuan Hsien (TW); Kun-Fu Chuang, Taoyuan Hsien (TW)

(73) Assignee: Delta Electronics, Inc., Kuei San, Taoyuan Hsien (TW)

( * ) Notice: Subject to any disclaimer, the term of this patent is extended or adjusted under 35 U.S.C. 154(b) by 613 days.

(21) Appl. No.: 12/209,891

(22) Filed: Sep. 12, 2008

(65) Prior Publication Data

US 2009/0180901 A1 Jul. 16, 2009

(30) Foreign Application Priority Data

Jan. 15, 2008 (TW) ..... 97101493 A

(51) Int. Cl.
*F04B 35/04* (2006.01)

(52) U.S. Cl.
USPC ..... 417/423.7; 417/353; 310/156.12

(58) Field of Classification Search
USPC ..... 417/353, 423.7, 423.1, 423.12; 310/10, 310/12.01, 12.02, 68 R, 43, 156.01, 310/156.11–156.14, 90, 67, 62–63
See application file for complete search history.

(56) References Cited

U.S. PATENT DOCUMENTS

| | | | | |
|---|---|---|---|---|
| 3,513,339 | A * | 5/1970 | Harris et al. | 310/90 |
| 4,482,302 | A * | 11/1984 | Grignon | 417/354 |
| 4,549,858 | A * | 10/1985 | Vettori et al. | 417/353 |
| 5,982,066 | A * | 11/1999 | Marracino et al. | 310/91 |
| 6,196,802 | B1 * | 3/2001 | Matsumoto | 416/229 R |
| RE37,261 | E * | 7/2001 | Schmider et al. | 417/423.7 |
| 6,737,769 | B2 * | 5/2004 | Horng et al. | 310/68 R |
| 6,841,112 | B1 * | 1/2005 | Brown et al. | 264/272.19 |
| 7,728,476 | B2 * | 6/2010 | Yano et al. | 310/91 |
| 8,113,793 | B2 * | 2/2012 | Yu et al. | 417/354 |
| 2006/0138878 | A1 * | 6/2006 | Hoffman et al. | 310/43 |
| 2006/0250039 | A1 * | 11/2006 | Yamamoto | 310/90 |
| 2009/0010769 | A1 * | 1/2009 | Laufer et al. | 417/201 |

FOREIGN PATENT DOCUMENTS

| | | |
|---|---|---|
| CN | 2916639 | 6/2007 |
| TW | 413977 | 12/1998 |
| TW | 200744290 | 12/2007 |
| WO | WO 2006027043 A1 * | 3/2006 |

* cited by examiner

*Primary Examiner* — Charles Freay
*Assistant Examiner* — Thomas Fink
(74) *Attorney, Agent, or Firm* — Muncy, Geissler, Olds & Lowe, PLLC

(57) ABSTRACT

A fan includes an impeller and an inner rotor motor. The inner rotor motor connects to the impeller and drives it to rotate. The inner rotor motor includes a bushing, a shaft, a magnetic conducting shell, a magnetic element and a stator. The shaft passes through the bushing and is coupled to the impeller. The magnetic conducting shell is coupled to the shaft and telescoped to the bushing. The magnetic element is disposed around outside of the magnetic conducting shell. The stator is disposed around outside of the magnetic element.

20 Claims, 4 Drawing Sheets

FAN AND INNER ROTOR MOTOR THEREOF

CROSS REFERENCE TO RELATED APPLICATIONS

This Non-provisional application claims priority under 35 U.S.C. §119(a) on Patent Application No(s). 097101493, filed in Taiwan, Republic of China on Jan. 15, 2008, the entire contents of which are hereby incorporated by reference.

BACKGROUND OF THE INVENTION

1. Field of Invention

The present invention relates to a fan and a motor thereof and, in particular, to a fan and an inner rotor motor thereof.

2. Related Art

Nowadays, electronic products are minimized and have powerful functions, so that the demands for heat dissipation are increased accordingly. That is, the heat dissipation efficiency must be increased for the electronic products. Because the fan has the advantages of low cost and well developed, it is widely used as a heat dissipating device.

Referring to FIG. 1, a conventional fan 1 has an impeller 11, a motor 12 and a frame 13. The motor 12 has a rotor magnet 121 and a stator 122. The rotor magnet 121 is disposed on the inner surface of the hub 111 of the impeller 11, and the rotor magnet 121 is located around outside of the stator 122 corresponding to the stator 122.

However, when the rotor magnet 121 is disposed around the outside of the stator 122, the rotation radius, which is the distance between the rotor magnet 121 and the axis 123, is long. Thus, the rotational inertia of the rotor magnetic 121 is large. Therefore, the conventional fan 1 requires higher initializing voltage and needs more time to reach the rated speed.

Also, the large rotational inertia of the rotor magnet 121 causes the poor response speed of the fan 1 in different duty cycles, so that the rotation speed of the fan 1 changes slowly. Moreover, when the fan 1 rotates in high speed, a significant vibration will occur. Furthermore, since the hub 111 of the impeller 11 is configured to cover the rotor magnet 121 and the stator 122, it definitely has sufficient dimension, which causes the decreased area of the airflow channel so as to decreasing the air flux of the fan 1.

SUMMARY OF THE INVENTION

In view of the foregoing, the present invention is to provide an inner rotor motor capable of reducing the rotational inertia of the rotor, and a fan using this inner rotor motor to increase the area of the airflow channel.

To achieve the above, an inner rotor motor according to the present invention includes a bushing, a shaft, a magnetic conducting shell, a magnetic element and a stator. The shaft passes through the bushing. The magnetic conducting shell is coupled to the shaft and telescoped to the bushing. The magnetic element is disposed around outside of the magnetic conducting shell. The stator is disposed around outside of the magnetic element.

To achieve the above, the present invention also discloses a fan including an impeller, a bushing, a shaft, a magnetic conducting shell, a magnetic element and a stator. The shaft passes through the bushing and is coupled to the impeller. The magnetic conducting shell is coupled to the shaft and telescoped to the bushing. The magnetic element is disposed around outside of the magnetic conducting shell. The stator is disposed around outside of the magnetic element.

As mentioned above, in the fan and inner rotor motor thereof according to the present invention, the magnetic conducting shell and the magnetic element of the rotor are disposed between the shaft and the stator so as to reduce the dimension of the rotor as well as that of the hub. As a result, the area of the airflow channel can be increased, and thus the air flux of the fan can be increased. In addition, the weight of the rotor with the reduced dimension is decreased, and the heavy components, such as the magnetic conducting shell and the magnetic element of the rotor, are configured at the central part of the fan, so that the rotational inertia of the rotor of the present invention can be significantly smaller than that of the conventional inner rotor motor. Therefore, the inner rotor motor can quickly reach the rated speed without high initializing voltage, and it can also quickly response various duty cycles to modify the rotation speed. Moreover, the bushing, magnetic conducting shell and magnetic element of the present invention can be combined in various ways. For example, they can be fixed by insert molding for increasing the structure intensity of the fan.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
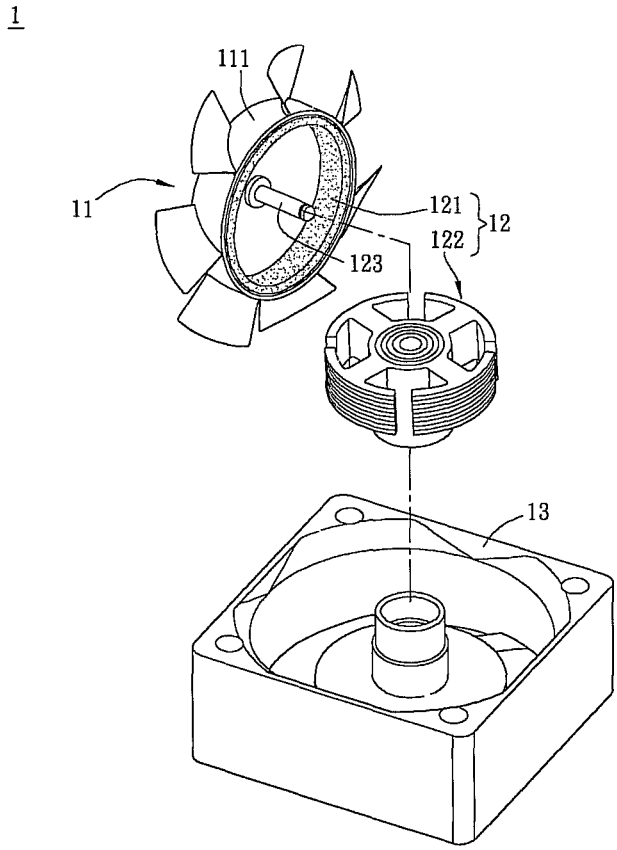
FIG. 1 (PRIOR ART)
FIG. 1 is a schematic illustration showing a conventional fan.
Figure 2:
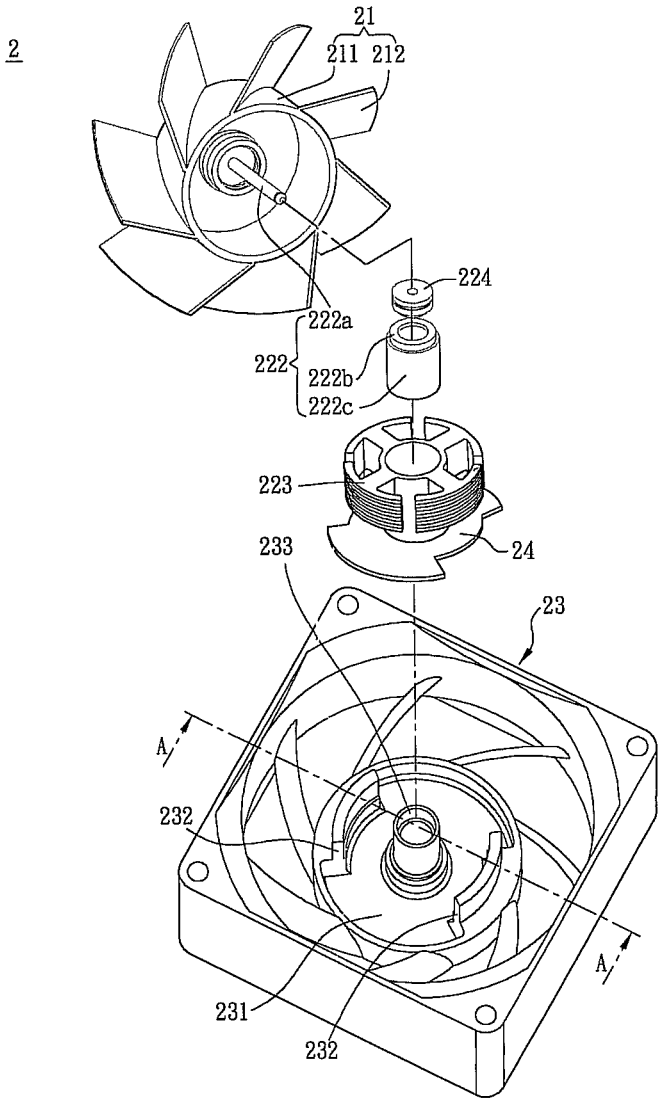
FIG. 2 is an exploded illustration showing a fan according to a first embodiment of the present invention.

Referring to FIG. 2, a fan 2 according to a first embodiment of the present invention includes an impeller 21 and an inner rotor motor. The fan 2 can be an axial-flow fan or a centrifugal fan. In this embodiment, the fan 2 is, for example but not limited to, an axial-flow fan. In addition, the fan 2 further includes a frame 23, and the impeller 21 and the inner rotor motor are disposed in the frame 23. The fan 23 has a base 231 and bushing 233. The base 231 is located at the center of the bottom portion of the frame 23. The bushing 233 can be made of plastic or metal and the bushing 233 is disposed on the base 231. The bushing 233 and the base 231 can be integrally formed as a single unit by way of, for example, insert molding. It is noted that the bushing 233 is not limited to be coupled to the base 231 by way of integral formation or insert molding formation. For instance, they can be individually formed first and then be coupled to each other.

The impeller 21 has a hub 211 and a plurality of blades 212 disposed around the hub 211. The inner rotor motor is coupled to the impeller 21 to drive the impeller 21 to rotate. The inner rotor motor includes a rotor 222 and a stator 223. The rotor 222 has a shaft 222*a*, a magnetic conducting shell 222*b* and a magnetic element 222*c*.

The shaft 222*a* passes through the bushing 233 and is coupled to the impeller 21. The magnetic conducting shell

222*b* is coupled to the shaft 222*a* and telescoped to the bushing 233. The magnetic conducting shell 222*b* is coupled to the shaft 222*a* by a fixing element 224. In addition, the shaft 222*a* and the magnetic conducting shell 222*b* are coupled and fixed to the hub 211 by the fixing element 224. The fixing element 224 can be made of plastic or metal, and it can be coupled to the hub 211 by insert molding. The magnetic element 222*c* is telescoped to the magnetic conducting shell 222*b*. Therefore, when the impeller 21 rotates, the shaft 222*a*, the magnetic conducting shell 222*b* and the magnetic element 222*c* can rotate simultaneously.

The stator 223 is disposed around and corresponding to the magnetic element 222*c*. The frame 23 has a position structure 232 disposed at the circumference of the base 231. The position structure 232 is, for example, a U-shaped structure to position the stator 223.

Figure 3:
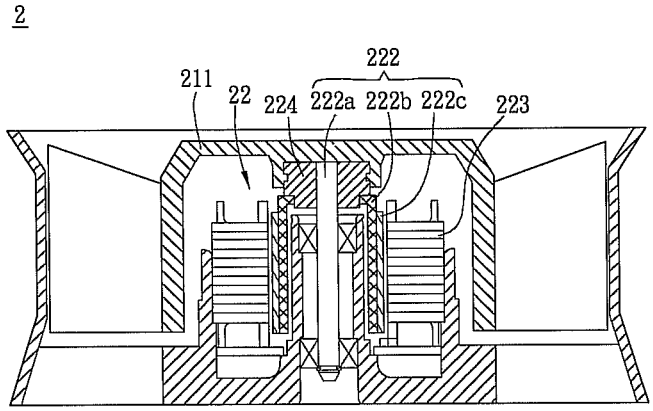
FIG. 3 is a cross-sectional view of the assembled fan of FIG. 2 taken along line A-A.

FIG. 3 is a cross-sectional view of the assembled fan of FIG. 2 taken along line A-A. Referring to FIG. 3, the magnetic conducting shell 222*b* and the magnetic element 222*c* are disposed between the shaft 222*a* and the stator 223, thereby reducing the dimensions of the rotor 222 and the hub 211. As the results, the area of the airflow channel can be increased so as to increase the air flux of the fan 2. In addition, the weight of the rotor 222 with the reduced dimension can be decreased, and the heavy elements such as the magnetic conducting shell 222*b* and the magnetic element 222*c* of the rotor 222 are configured at the central part of the fan 2, so that the rotational inertia of the rotor 222 of the present invention can be significantly decreased. Therefore, the inner rotor motor 2 can quickly reach the rated speed without high initializing voltage, and it can also quickly response various duty cycles to modify the rotation speed.

Because the dimensions of the hub 211 and the rotor 222 are reduced, the dimension of the base 231 is also reduced. To ensure that the circuit board 24 has sufficient layout area, the circuit board 24 can extend outwardly from the position structure 232 as shown in FIG. 2, so that the dimension of the circuit board 24 can be increased.

Figure 4:
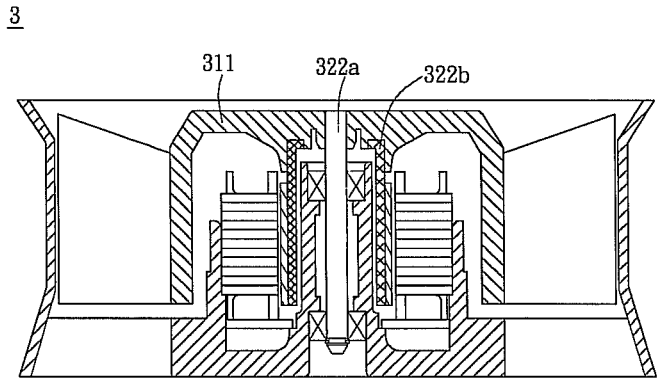
FIGS. 4 and 5 are schematic illustrations showing two fans according to a second embodiment and a third embodiment of the present invention.

FIG. 4 is a schematic illustration showing a fan 3 according to a second embodiment of the present invention. Referring to FIG. 4, the difference between the fan 3 and the fan 2 of the first embodiment is in that the hub 311 is coupled to the shaft 322*a* and the magnetic conducting shell 322*b* by insert molding. Thus, the hub 311, the shaft 322*a* and the magnetic conducting shell 322*b* are integrally formed as a single unit by way of, for example but not limited to, insert molding. Therefore, a fixing element is not required to fix the hub 311, the shaft 322*a* and the magnetic conducting shell 322*b*. This can improve the structure intensity of the fan 3 and lower the cost of the fan 3 due to the reduced elements.

Figure 5:
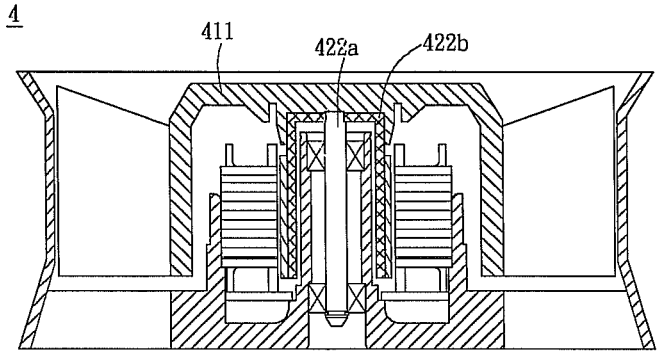

FIG. 5 is a schematic illustration showing a fan 4 according to a third embodiment of the present invention. Referring to FIG. 5, the difference between the fan 4 and the fan 2 of the first embodiment is in that the shaft 422*a* is coupled to the magnetic conducting shell 422*b* first, and then the hub 411 is integrally formed with the shaft 422*a* and the magnetic conducting shell 422*b* as a single unit by way of, for example but not limited to, insert molding: This also can improve the structure intensity of the fan 4.

In summary, in the fan and inner rotor motor thereof according to the present invention, the magnetic conducting shell and the magnetic element of the rotor are disposed between the shaft and the stator so as to reduce the dimension of the rotor as well as that of the hub. As a result, the area of the airflow channel can be increased, and thus the air flux of the fan can be increased. In addition, the weight of the rotor with the reduced dimension is decreased, and the heavy components, such as the magnetic conducting shell and the magnetic element of the rotor, are configured at the central part of the fan, so that the rotational inertia of the rotor of the present invention can be significantly smaller than that of the conventional inner rotor motor. Therefore, the inner rotor motor can quickly reach the rated speed without high initializing voltage, and it can also quickly response various duty cycles to modify the rotation speed. Moreover, the bushing, magnetic conducting shell and magnetic element of the present invention can be combined in various ways. For example, they can be fixed by insert molding for increasing the structure intensity of the fan.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. An inner rotor motor adapted to be used with an impeller, comprising:

a bushing;

a rotor comprising a shaft passing through the bushing, a magnetic conducting shell coupled to the shaft and telescoped over the bushing, and a magnetic element disposed outside of the magnetic conducting shell, the bushing being within the magnetic conducting shell, wherein the magnetic conducting shell is coupled to the shaft by a fixing element, wherein the fixing element is coupled to an inner surface of a hub of the impeller by insert molding, the hub having a downwardly extending wall with an inner sidewall and an outer sidewall, blades fixed to the outer sidewall of the hub, the magnetic conducting shell being spaced from and out of contact with the inner sidewall of the hub; and a stator disposed outside the magnetic element, the magnetic conducting shell extending between the stator and the bushing.

2. The inner rotor motor according to claim 1, wherein the fixing element comprises plastic or metal.

3. The inner rotor motor according to claim 1, wherein the bushing comprises plastic or metal.

4. A fan, comprising:

an impeller having a hub, the hub having a downwardly extending wall with an inner sidewall and an outer sidewall, the outer sidewall having a plurality of blades disposed thereon;

a shaft coupled to the impeller;

a magnetic conducting shell coupled to the shaft and the hub, the magnetic conducting shell being spaced from and out of contact with the inner sidewall of the hub;

a magnetic element disposed outside the magnetic conducting shell;

a stator disposed outside the magnetic element; and a frame having a base and a position structure disposed on the base for positioning the stator.

5. The fan according to claim 4, wherein the shaft, the magnetic conducting shell and the magnetic element constitute a rotor.

6. The fan according to claim 4, wherein the impeller comprises a plurality of blades disposed around the hub.

7. The fan according to claim 6, wherein the hub, and the shaft are connected by way of integral formation or insert molding formation to form a single piece.

8. The fan according to claim 6, wherein the magnetic conducting shell and the shaft are connected with each other.

9. The fan according to claim 8, wherein the magnetic conducting shell and the shaft are connected with each other and then coupled to the hub by way of integral formation or insert molding formation.

10. The fan according to claim 6, wherein the magnetic conducting shell is coupled to the shaft by a fixing element.

11. The fan according to claim 10, wherein the fixing element comprises plastic or metal.

12. The fan according to claim 10, wherein the fixing element is coupled to the hub by insert molding.

13. The fan according to claim 4, wherein the frame further comprises a bushing disposed on the base and made of plastic or metal.

14. The fan according to claim 4, wherein the impeller is disposed in the frame, and the fan is an axial-flow fan or a centrifugal fan.

15. The fan according to claim 13, wherein the bushing is connected with the base by way of integral formation or insert molding formation to form a single piece.

16. The fan according to claim 13, wherein the bushing and the base are individually formed and then coupled to each other.

17. The fan according to claim 4, wherein the position structure is a U-shaped structure.

18. The fan according to claim 4, wherein the magnetic conducting shell has an annular shape with a uniform circumference, both ends of the magnetic conducting shell having an opening.

19. A fan comprising:

a bushing;

a rotor comprising a shaft passing through the bushing;

an impeller having a hub attached to the shaft, the hub having a downwardly extending wall with an inner sidewall and an outer sidewall, the outer sidewall having a plurality of blades disposed thereon;

a magnetic conducting shell telescoping over the bushing, the magnetic conducting shell coupled to the hub as a single unit and having an opening at a top thereof for allowing the shaft to pass therethrough, the magnetic conducting shell being spaced from and out of contact with the inner sidewall of the hub;

a magnetic element disposed outside the magnetic conducting; and a stator disposed outside the magnetic element, wherein the magnetic conducting shell extends between the stator and the bushing.

20. A fan comprising:

a bushing;

a rotor comprising a shaft passing through the bushing;

an impeller having a hub attached to the shaft, the hub having a downwardly extending wall with an inner sidewall and an outer sidewall, the outer sidewall having a plurality of blades disposed thereon;

a magnetic conducting shell telescoping over the bushing, the magnetic conducting shell coupled to the shaft and the hub, wherein the shaft is coupled to the magnetic conducting shell first, and then the hub is formed with the shaft and the magnetic conducting shell as a single unit, the magnetic conducting shell being spaced from and out of contact with the inner sidewall of the hub;

a magnetic element disposed outside the magnetic conducting shell; and a stator disposed outside the magnetic element;

wherein the magnetic conducting shell extends between the stator and the bushing.

* * * * *